US007207305B2

(12) United States Patent
Dolker

(10) Patent No.: US 7,207,305 B2
(45) Date of Patent: Apr. 24, 2007

(54) METHOD FOR ENGINE SPEED CONTROL

(75) Inventor: Armin Dolker, Immenstaad (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 30 days.

(21) Appl. No.: 10/552,928

(22) PCT Filed: Apr. 6, 2004

(86) PCT No.: PCT/EP2004/003620

§ 371 (c)(1),
(2), (4) Date: Oct. 11, 2005

(87) PCT Pub. No.: WO2004/090310

PCT Pub. Date: Oct. 21, 2004

(65) Prior Publication Data

US 2006/0278191 A1 Dec. 14, 2006

(30) Foreign Application Priority Data

Apr. 8, 2003 (DE) ..... 103 15 881

(51) Int. Cl.

| | |
|---|---|
| ***F02N 11/00*** | (2006.01) |
| ***F02D 45/00*** | (2006.01) |
| ***F02D 31/00*** | (2006.01) |
| ***F02D 41/06*** | (2006.01) |

(52) U.S. Cl. ..... 123/179.3; 123/352; 701/104

(58) Field of Classification Search ..... 123/179.3, 123/179.4, 179.12, 179.16, 179.17, 179.28, 123/352; 701/104, 105, 110, 111, 115
See application file for complete search history.

(56) References Cited

U.S. PATENT DOCUMENTS

| | | | | |
|---|---|---|---|---|
| 5,613,474 | A | 3/1997 | Nakamura et al. | 123/496 |
| 6,366,049 | B1 | 4/2002 | Chen et al. | 318/799 |
| 7,028,657 | B2 * | 4/2006 | Sah et al. | 123/179.3 |
| 7,072,759 | B2 * | 7/2006 | Dolker | 701/104 |
| 2005/0224047 | A1 * | 10/2005 | Doelker | 123/352 |
| 2005/0279324 | A1 * | 12/2005 | Dolker | 123/352 |

FOREIGN PATENT DOCUMENTS

| | | |
|---|---|---|
| DE | 102 21 681 | 11/2003 |
| DE | 102 52 399 | 6/2004 |
| WO | WO 03/098793 A | 11/2003 |

* cited by examiner

*Primary Examiner*—Noah P. Kamen
*Assistant Examiner*—Arnold Castro
(74) *Attorney, Agent, or Firm*—Klaus P. Stoffel; Wolff & Samson PC

(57) ABSTRACT

A method for engine speed control for an internal combustion engine generating unit (1) is disclosed, whereby a first time point is set when the actual speed (nM(IST)) exceeds a threshold value and a second time point set when the actual speed (nM(IST)) exceeds a start speed. A time span is then calculated from both time points. Depending on said time span, a run-up ramp and the regulation parameters for a speed regulator are selected.

9 Claims, 5 Drawing Sheets

METHOD FOR ENGINE SPEED CONTROL

BACKGROUND OF THE INVENTION

The invention concerns a method for the closed-loop speed control of an internal combustion engine-generator unit.

An internal combustion engine provided as a generator drive is usually delivered by the manufacturer to the end customer without the coupling and generator. The coupling and generator are installed at the end customer's facility. To guarantee a constant rated frequency for the current supply into the power supply system, the internal combustion engine is operated in a closed-loop speed control system. In this regard, the speed of the crankshaft is detected as a controlled variable and compared with a set speed, i.e., the reference input. The resulting control deviation is converted by a speed controller to a correcting variable for the internal combustion engine, for example, a set injection quantity.

Since definite data on the coupling characteristics and the moment of inertia of the generator are often unavailable to the manufacturer before the delivery of the internal combustion engine, the electronic control unit is often delivered with a robust set of controller parameters, i.e., the so-called standard set of parameters. One problem that exists in a closed-loop speed control system is that torsional vibrations, which are superimposed on the controlled variable, can be reinforced by the speed controller. Particularly critical are the low-frequency vibrations caused by the internal combustion engine, for example, torsional vibrations of the 0.5-th and 1st order. When the internal combustion engine-generator unit is started, the amplitudes of the torsional vibrations can become so large due to reinforcement by the speed controller that a limit speed is exceeded, and the internal combustion engine is shut off.

The problem of instability is countered by a speed filter in the feedback path of the closed-loop speed control system. As an additional measure, the controller parameters of the speed controller are changed, i.e., the proportional, integral, or differential component. A method of this type for switching the filter and a method for adapting the controller parameters is described, for example, in the unprepublished application DE 102 21 681.9. A problem associated with these methods is that they are not activated until unstable behavior of the internal combustion engine-generator unit already exists and has been detected.

A speed run-up ramp or its slope is stored in the aforesaid standard set of parameters for the starting process. To allow the fastest possible run-up, this parameter is set to a large value, e.g., 550 rpm/second. In the case of a generator with a large moment of inertia, a large deviation can develop between the set run-up ramp and the actual run-up ramp. This control deviation of the actual speed from the set speed causes a significant increase in the set injection quantity. In a diesel engine with a common-rail injection system, the significant increase in the set injection quantity promotes the formation of black smoke. The significant increase in the set injection quantity also causes nonoptimal determination of the injection start and the set rail pressure, since both of these values are computed from the set injection quantity. For the manufacturer of the internal combustion engine, this means that an on-site service technician must adapt the run-up ramp to the specific conditions. This is time-consuming and expensive.

A method described in the unprepublished application DE 102 52 399.1 deals with this problem of high adjustment expense. During the starting operation, an actual run-up ramp is determined from the actual speed. This actual run-up ramp is then set as the set run-up ramp. This method has proven effective in practice, but the optimum set run-up ramp becomes effective only starting with the second starting operation.

SUMMARY OF THE INVENTION

The goal of the invention is to improve the starting operation of an internal combustion engine-generator unit.

In accordance with the invention, a time interval is determined which the actual speed requires to pass through a speed range. The speed range is below the starting speed, which in practice is, e.g., 600 rpm. The speed range is defined by a limit and the starting speed. The limit in turn is selected in practice slightly higher than the speed of the starter, e.g., 300 rpm. The run-up ramp and the controller parameters of the speed controller are then selected as a function of the measured time interval. The characterizing characteristics are thus determined predictively. Corresponding characteristic curves are provided.

The invention ensures that each engine start occurs with the optimum run-up ramp. Changed environmental conditions are also taken into account, e.g., the cooling water temperature. As is well known, a cold internal combustion engine requires a somewhat flatter run-up ramp. The optimum controller parameters have already been determined by the time the starting speed has been reached. The starting speed corresponds in practice to, e.g., 600 rpm, and characterizes the start of the run-up ramp. The invention already guarantees stable engine operation during the run-up. Instabilities are effectively prevented for the entire operation.

To increase the reliability of the internal combustion engine-generator unit, an error control system is provided, in which the time interval is compared with a limit. A time interval that is too large indicates that, e.g., the fuel pressure in the injection system is too low. As a consequent response, it is provided that, when the error is set, a diagnostic input occurs, and an emergency stop is activated.

BRIEF DESCRIPTION OF THE DRAWINGS

The drawings illustrate a preferred embodiment of the invention.

DETAILED DESCRIPTION OF THE INVENTION

Figure 1:
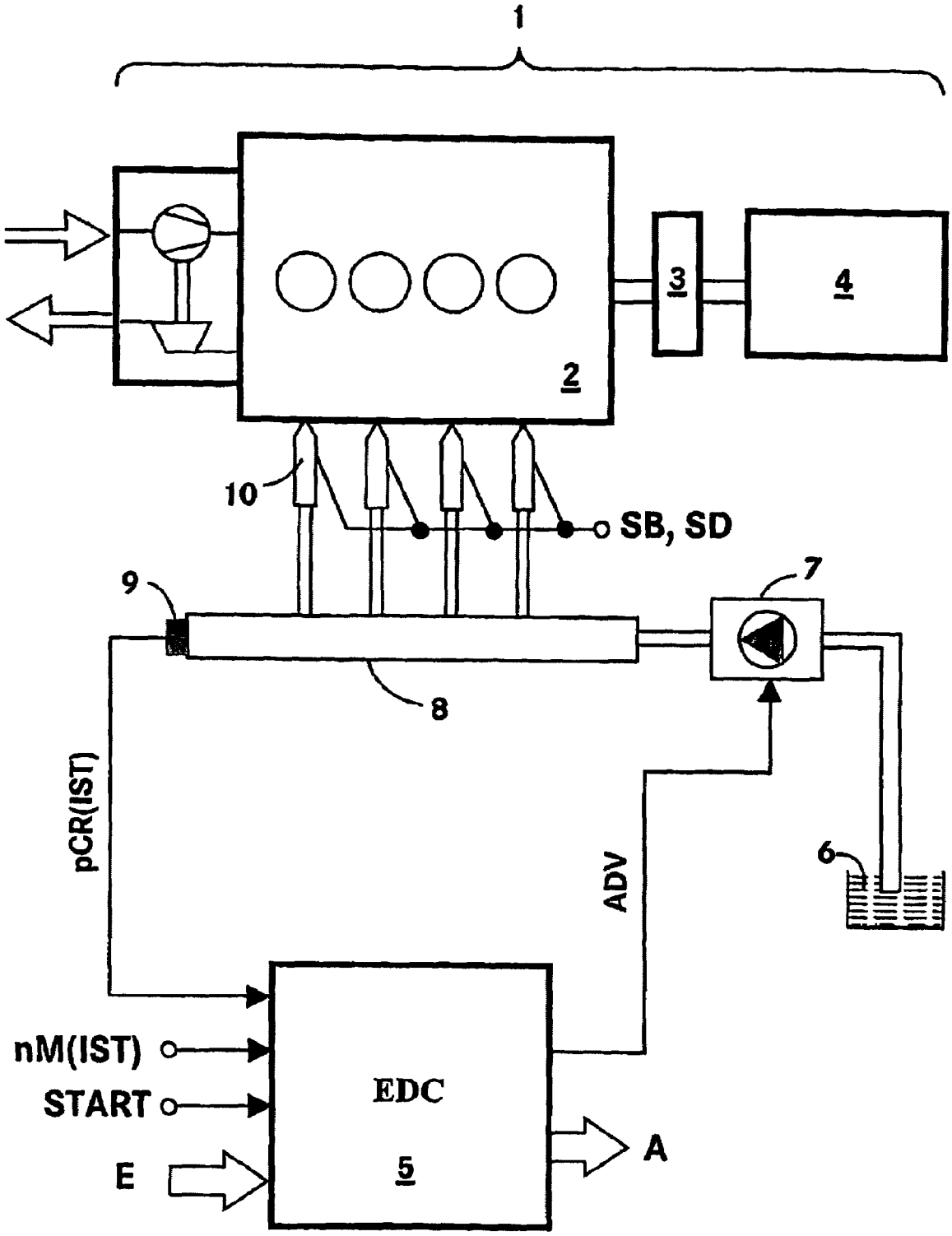
FIG. 1 shows a system diagram.

FIG. 1 shows a system diagram of the total system of an internal combustion engine-generator unit 1. An internal combustion engine 2 drives a generator 4 via a shaft and a transmission member 3. In practice, the transmission member 3 can include a coupling. In the illustrated internal combustion engine 2, the fuel is injected by a common-rail injection system, which comprises the following components: pumps 7 with a suction throttle for conveying the fuel from a fuel tank 6, a rail 8 for storing the fuel, and injectors 10 for injecting the fuel from the rail 8 into the combustion chambers of the internal combustion engine 2.

The mode of operation of the internal combustion engine is controlled by an electronic control unit (EDC) 5. The electronic control unit 5 contains the usual components of a microcomputer system, for example, a microprocessor, interface adapters, buffers, and memory components (EEPROM, RAM). The relevant operating characteristics for the operation of the internal combustion engine 2 are applied in the memory components in input-output maps/characteristic curves. The electronic control unit 5 uses these to compute the output variables from the input variables. FIG. 1 shows the following input variables as examples: an actual rail pressure pCR(IST), which is measured by a rail pressure sensor 9, an actual speed signal nM(IST) of the internal combustion engine 2, and input variable E, and a signal START for the start set-point assignment. The start set point assignment is activated by the operator. Examples of input variables E are the charge air pressure of a turbocharger and the temperatures of the coolant/lubricant and the fuel.

As output variables of the electronic control unit 5, FIG. 1 shows a signal ADV for controlling the pumps 7 with a suction throttle and an output variable A. The output variable A is representative of the other control signals for automatically controlling the internal combustion engine 2, for example, the injection start SB and the injection duration SD.

Figure 2:
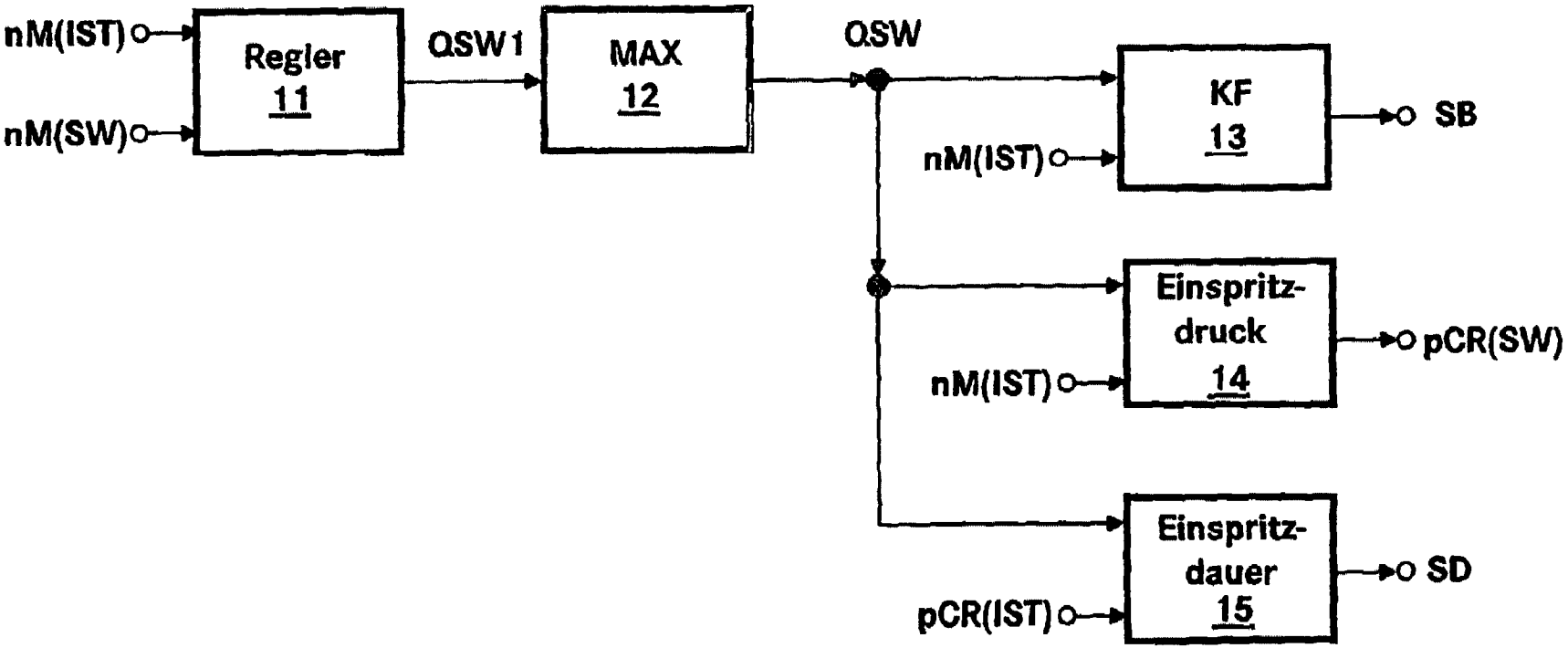
FIG. 2 shows a functional block diagram.

FIG. 2 shows a functional block diagram for computing the injection start SB, the set rail pressure pCR(SW), and the injection duration SD. A speed controller 11 computes a set injection quantity QSW1 from the actual speed nM(IST) of the internal combustion engine and the set speed nM(SW). This computed value is limited to a maximum value by a limiter 12. The output quantity, which corresponds to the set injection quantity QSW, is the input variable of the input-output maps 13 to 15. The injection start SB is computed by the input-output map 13 as a function of the set injection quantity QSW and the actual speed nM(IST). The set rail pressure pCR(SW) is computed by the input-output map 14 as a function of the set injection quantity QSW and the actual speed nM(IST). The injection duration SD is determined by the input-output map 15 as a function of the set injection quantity QSW and the actual rail pressure pCR(IST).

It is apparent from the functional block diagram that a prolonged large control deviation leads to a significant increase in the set injection quantity QSW1. This significant increase is limited to a maximum value by the limiter 12. This maximum value of the set injection quantity QSW in turn causes a nonoptimum injection start SB and a nonoptimum set rail pressure pCR(SW), i.e., the set injection pressure, to be computed. The set injection quantity QSW is representative of a power-determining signal QP. In accordance with the invention, a power-determining signal QP can also be understood to mean a control rod distance or a set torque.

Figure 3:
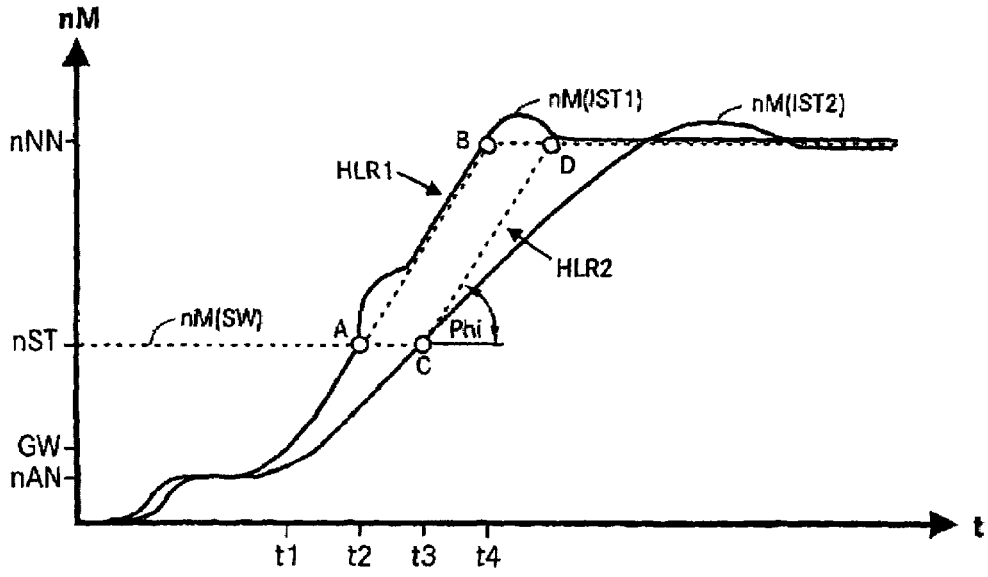
FIG. 3 shows a time diagram (state of the art).

FIG. 3 shows the starting operation for an internal combustion engine-generator unit in accordance with the state of the art. Time is plotted on the x-axis. The speed nM of the internal combustion engine is plotted on the y-axis. The starting operation with a generator that has a small moment of inertia is shown as solid curve nM(IST1). The starting operation for the same internal combustion operation with a generator that has a large moment of inertia is shown as solid curve nM(IST2). The set speed nM(SW), i.e., the reference input of the closed-loop speed control system, is shown as a broken line. The straight line with the points AB corresponds to the run-up ramp HLR1. The straight line between the points C and D corresponds to the run-up ramp HLR2. In the present example, the slope Phi of the two run-up ramps is identical, e.g., 550 rpm/s.

The starting operation for an internal combustion engine-generator unit on the basis of the curve nM(IST1) runs as follows:

After the start button has been pushed, the starter engages, and the internal combustion engine starts to turn. This increases, initially up to a starter speed nAN, e.g., 120 rpm. At the end of the synchronization process, fuel is injected into the combustion chambers. A first time t1 is set when the actual speed nM(IST1) exceeds a limit GW, e.g., 300 rpm. At the same time, the starter is deactivated, so that it disengages. Due to the injection, the actual speed nM(IST1) increases until it exceeds the starting speed nST. When the starting speed nST is exceeded, a second time t2 is set. As a result of the slope of the run-up ramp HLR1 being too small, the actual speed nM(IST1) initially significantly overshoots the run-up ramp in the case of a generator with a very small moment of inertia and then levels off to the run-up ramp HLR1 and runs up to the rated speed nNN. The rated speed is reached at point B, time t4. At point B, the actual speed nM(IST1) overshoots the set speed nM(SW).

It is apparent from the behavior of the actual speed nM(IST1) that the internal combustion engine could also be operated with a somewhat steeper run-up ramp than run-up ramp HLR1. This would shorten the run-up time corresponding to the time interval t2/t4. A faster run-up ramp is needed especially when the internal combustion engine is started without the generator. The generator is then engaged only after the rated speed nNN has been reached, e.g., by means of a freewheel. In an application of this type, a run-up that is as fast as possible is desired, since a rotational energy storage unit can make energy available only for a limited time in the case of fast-readiness units.

When a generator with a large moment of inertia is used, the actual speed runs according to the solid curve nM(IST2). When the starting speed is reached at point C, the run-up ramp HLR2 starts to run, i.e., time t3. However, due to the large moment of inertia, the actual speed nM(IST2) runs below the run-up ramp HLR2. This leads to a sharp increase in the injection quantity and thus to the formation of black smoke. To avoid the formation of black smoke, it is thus necessary in this case to use a run-up ramp with a smaller slope.

Figure 4:
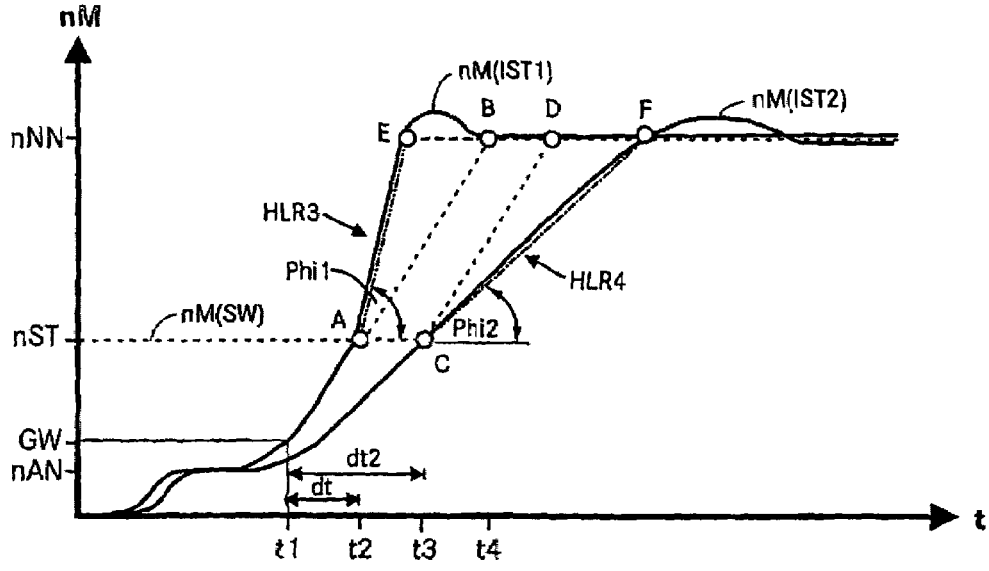
FIG. 4 shows a time diagram (invention).
Figure 5:
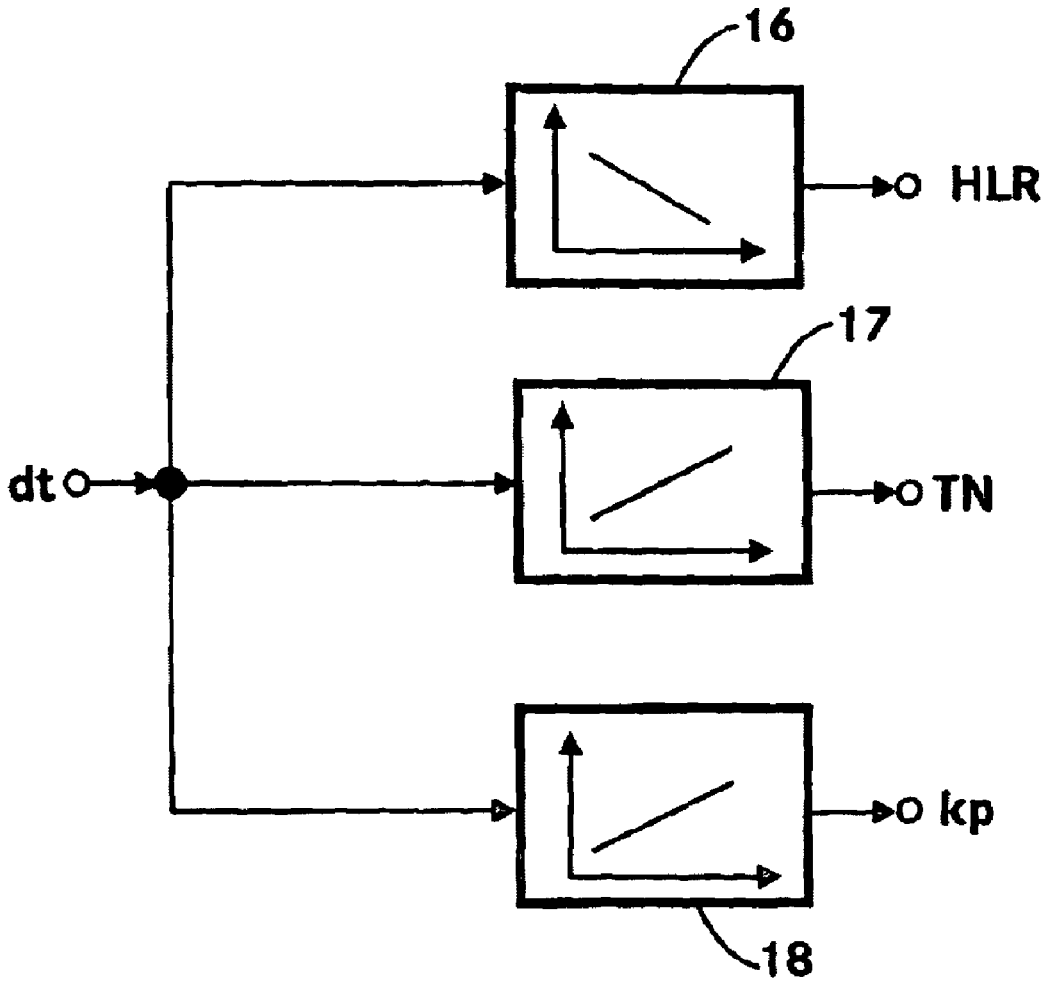
FIG. 5 shows a functional block diagram.

FIG. 4 shows a starting operation for an internal combustion engine-generator unit in accordance with the invention. The set speed nM(SW) is drawn as a broken line. Its behavior, including the run-up ramps between points AB and CD, is identical to the behavior shown in FIG. 3. This behavior is explained further in conjunction with FIG. 5.

The behavior of the actual speed nM(IST1) up to time t2 is identical to its behavior in FIG. 3. When the actual speed nM(IST1) exceeds the limit GW, the first time t1 is set. At point A, the actual speed nM(IST1) exceeds the starting speed nST. The time t2 is set. A time interval dt is determined from the difference of the two times t1/t2. This time interval dt is critically determined by the moment of inertia of the generator that is used. A run-up ramp is determined by a characteristic curve 16 (see FIG. 5) as a function of the time interval dt. The characteristic curve 16 is constructed in such a way that a short time interval dt sets a run-up ramp with a large slope Phi1. In FIG. 4, as a result of this, the actual speed nM(IST1) runs along the new run-up ramp HLR3 with points AE, which has a significantly greater slope than run-up ramp HLR1 with points AB.

The controller parameters of the speed controller are selected by means of corresponding characteristic curves 17, 18 (see FIG. 5), likewise as a function of the measured time interval dt. The characteristic curve 17 assigns an integral-action time TN to the time interval dt. The characteristic curve 17 is constructed in such a way that a large integral-action time TN is assigned to a long time interval dt. Generators with a large moment of inertia require a larger integral-action time TN than generators with a small moment of inertia. The characteristic curve 18 assigns a proportional coefficient kp to the measured time interval dt. The characteristic curve 18 is constructed in such a way that a large proportional coefficient kp is assigned to a long time interval dt. Due to better damping, generators with a large moment of inertia can be operated with a larger proportional coefficient kp than generators with a small moment of inertia.

For the actual speed nM(IST2), corresponding to an internal combustion engine-generator unit with a large moment of inertia of the generator, the time interval dt2, which corresponds to the time interval t1/t3, is larger. This results in a run-up ramp HLR4, points CF, with a significantly lower slope Phi2 than the run-up ramp HLR2 of FIG. 3.

Figure 6:
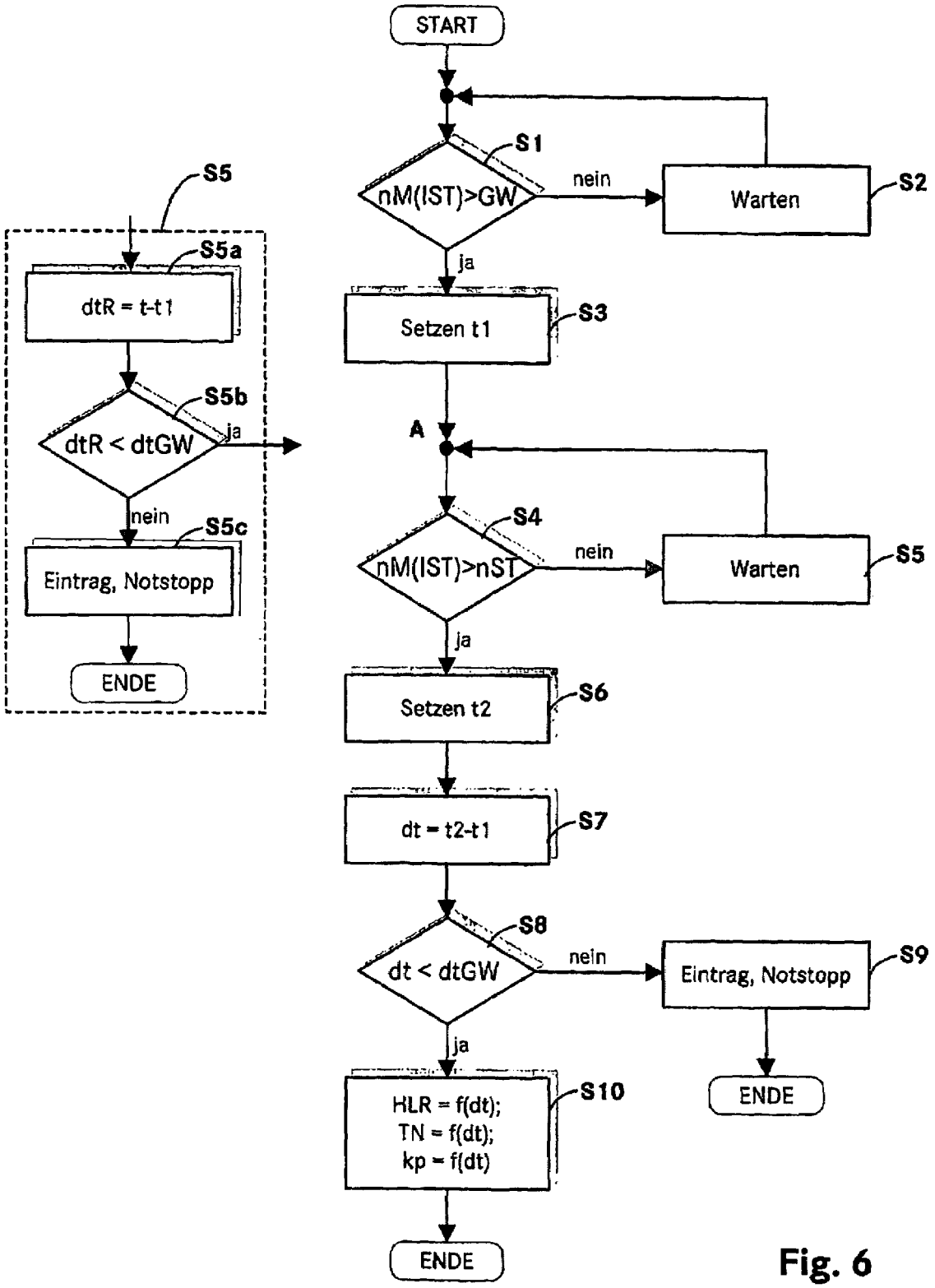
FIG. 6 shows a program flowchart.

FIG. 6 shows a program flowchart of the invention. A check is made at S1 to determine whether the actual speed nM(IST) is greater than the limit GW. If this is not the case, control passes to a wait loop at S2. If the actual speed nM(IST) has already exceeded the limit, the first time t1 is set at S3. A check is made at S4 to determine whether the actual speed nM(IST) is greater than the starting speed nST. If this is not yet the case, control passes to a wait loop at S5. When the starting speed nST has been exceeded, the second time t2 is set at S6. The time interval dt is then computed at S7 from the difference of the two times t1/t2. An error inquiry is made at S8 by checking whether the time interval dt is smaller than a limit dtGW. If the time interval dt is greater than or equal to the permissible limit dtGW, then a diagnostic input is undertaken at S9, and an emergency stop is triggered. If the inquiry at S8 shows that the time interval dt is within the permissible range, then the run-up ramp HLR, the integral-action time TN, and the proportional coefficient kp are determined at S10 as a function of the time interval dt. The program flowchart then ends.

In FIG. 6, the wait loop S5 is shown in greater detail with the reference symbols S5*a*, S5*b*, and S5*c*. After S4, the difference dtR between the present time t and time t1 is taken. The inquiry S5*b* checks whether the difference dtR is smaller than a limit dtGW. If this is the case, then the program returns to point A. The program flow then continues with S4 as described above. If it is determined at S5*b* that the limit dtGW has been reached or exceeded, then a diagnostic input is undertaken at S5*c*, and an emergency stop is triggered.

The above description reveals the following advantages of the invention:

The internal combustion engine carries out each starting operation with the optimum run-up ramp. Changed environmental conditions are taken into account in this process.

The optimum speed controller parameters are already determined by the time the starting speed nST has been reached. This guarantees that a stable operation is already taking place during the run-up. Instabilities can thus be excluded for the entire operation.

Problems during starting, e.g., due to the fuel admission pressure being too low, are

The invention claimed is:

1. A method for closed-loop speed control of an internal combustion engine-generator unit during a starting operation, comprising the steps of: presetting a set speed (nM(SW)) by means of a run-up ramp (HLR), which begins with a starting speed (nST) and ends with a rated speed (nNN); determining a control deviation from a comparison of the set speed and actual speed (nM(SW), nM(IST)); computing a power-determining signal (QP) for controlling the actual speed (nM(IST)) from the control deviation by a speed controller; setting first time (t1) when the actual speed (nM(IST)) exceeds a limit (GW), i.e., (nM(IST)>GW); setting a second time (t2) when the actual speed (nM(IST) exceeds the starting speed (nST), i.e., (nM(IST)>nST); computing a time interval (dt) from the difference of the two times (t1, t2); and selecting the run-up ramp (HLR) and the controller parameters of the speed controller as a function of the time interval (dt).

2. The method for closed-loop speed control in accordance with claim 1, including determining the run-up ramp (HLR) from the time interval (dt) by a first characteristic curve and determining the controller parameters from the time interval (dt) by other characteristic curves.

3. The method for closed-loop speed control in accordance with claim 2, wherein the controller parameters are an integral-action time (TN) and a proportional coefficient (kp).

4. The method for closed-loop speed control in accordance with claim 3, wherein a long integral-action time (TN) and a large proportional coefficient (kp) are assigned to a long time interval (dt) by the other characteristic curves.

5. The method for closed-loop speed control in accordance with claim 2, wherein a run-up ramp (HLR) with a small slope (Phi) is assigned to a long time interval (dt).

6. The method for closed-loop speed control in accordance claim 1, including setting an error if the time interval (dt) reaches or exceeds a limit (dtGW), i.e., (dt≧dtGW).

7. The method for closed-loop speed control in accordance with claim 1, further including determining a time interval (dtR) between a present time (t) and the first time (t1) (dtR=t−t1), and setting an error if the time interval (dtR) reaches or exceeds a limit (dtGW), i.e., (dtR≧dtGW).

8. The method for closed-loop speed control in accordance with claim 6, wherein when the error is set, a diagnostic input occurs, and an emergency stop is activated.

9. The method for closed-loop speed control in accordance with claim 7, wherein when the error is set, a diagnostic input occurs, and an emergency stop is activated.

* * * * *